US007413407B2

(12) United States Patent
Liang

(10) Patent No.: US 7,413,407 B2
(45) Date of Patent: Aug. 19, 2008

(54) TURBINE BLADE COOLING SYSTEM WITH BIFURCATED MID-CHORD COOLING CHAMBER

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 568 days.

(21) Appl. No.: 11/093,161

(22) Filed: Mar. 29, 2005

(65) Prior Publication Data

US 2006/0222495 A1 Oct. 5, 2006

(51) Int. Cl.
*F01D 5/18* (2006.01)

(52) U.S. Cl. ..... 416/97 R

(58) Field of Classification Search ..... 416/97 R
See application file for complete search history.

(56) References Cited

U.S. PATENT DOCUMENTS 5,165,852 A 11/1992 Lee et al.
5,193,980 A 3/1993 Kaincz et al.
5,348,446 A 9/1994 Lee et al.
5,356,265 A 10/1994 Kercher
5,538,394 A * 7/1996 Inomata et al. ..... 416/97 R
5,700,131 A 12/1997 Hall et al.
5,720,431 A 2/1998 Sellers et al.
5,813,835 A 9/1998 Corsmeier et al.
5,931,638 A 8/1999 Krause et al.
6,106,231 A 8/2000 Brainch et al.
6,168,381 B1 1/2001 Reddy
6,206,638 B1 3/2001 Glynn et al.
6,402,471 B1 6/2002 Demers et al.

FOREIGN PATENT DOCUMENTS

JP 60198305 A 10/1985
JP 05263660 A 10/1993

* cited by examiner

*Primary Examiner*—Richard Edgar

(57) ABSTRACT

A cooling system for a turbine blade of a turbine engine having a bifurcated mid-chord cooling chamber for reducing the temperature of the blade. The bifurcated mid-chord cooling chamber may be formed from a pressure side serpentine cooling channel and a suction side serpentine cooling channel. The pressure side and suction side serpentine cooling channels may flow counter to each other, thereby yielding a more uniform temperature distribution than conventional serpentine cooling channels.

20 Claims, 5 Drawing Sheets

TURBINE BLADE COOLING SYSTEM WITH BIFURCATED MID-CHORD COOLING CHAMBER

FIELD OF THE INVENTION

This invention is directed generally to turbine blades, and more particularly to cooling systems in hollow turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. The cooling channels are often designed to account for the external pressure profile shown in FIG. 1. However, centrifugal forces and air flow at boundary layers often prevent some areas of the turbine blade from being adequately cooled, which results in the formation of localized hot spots. In addition, the hot gases increase the temperature of the blade, causing the development of thermal stresses through the blade. Thus, a need exists for an efficient turbine blade cooling system.

SUMMARY OF THE INVENTION

This invention relates to a turbine blade having an internal turbine blade cooling system formed from at least one cooling fluid cavity extending into an elongated blade. The cooling system may include at least one leading edge cooling channel, at least one trailing edge cooling channel, and a bifurcated mid-chord cooling chamber extending between the leading edge and trailing edge cooling channels. The bifurcated mid-chord cooling chamber may be formed from a pressure side serpentine cooling channel positioned proximate to a pressure side of the turbine blade and a suction side serpentine cooling channel positioned proximate to a suction side of the turbine blade.

The turbine blade may be formed from a generally elongated blade having a leading edge, a trailing edge, a tip section at a first end, a root coupled to the blade at an end generally opposite the first end for supporting the blade and for coupling the blade to a disc, and at least one cavity forming a cooling system in the blade. The cooling system may include at least one leading edge cooling channel positioned in close proximity to the leading edge of the generally elongated blade, at least one trailing edge cooling channel positioned in close proximity to the trailing edge of the generally elongated blade, and a bifurcated mid-chord cooling chamber positioned between the at least one leading edge cooling channel and the at least one trailing edge cooling channel. The bifurcated mid-chord cooling chamber may include a pressure side serpentine cooling channel in contact with a pressure sidewall of the generally elongated blade and a suction side serpentine cooling channel in contact with a suction sidewall of the generally elongated blade and separated from the at least one trailing edge cooling channel by a mid-chord rib. An aperture in the mid-chord rib may provide a cooling fluid passageway between the pressure and suction side serpentine cooling channels. The aperture may be positioned in the mid-chord rib to exhaust cooling fluids from the pressure side cooling fluids and to supply cooling fluids to the suction side serpentine cooling channel. An inlet may be positioned in a wall proximate to the root for allowing cooling fluids to enter the pressure side serpentine cooling channel, and an exhaust outlet may be positioned in the tip of the blade for exhausting cooling fluids from the suction side serpentine cooling channel.

The pressure side and suction side serpentine cooling channels may be formed from at least two pass serpentine channels. In at least one embodiment, the pressure side serpentine cooling channel may be formed from a triple pass serpentine channel, and the suction side serpentine cooling channel may be formed from a quadruple pass serpentine cooling channel. The pressure side and suction side serpentine cooling channels may also be positioned relative to each other such that a cooling fluid flow direction through the suction side serpentine cooling channel is generally opposite to the cooling fluid flow in adjacent portions of the pressure side serpentine cooling channel, thereby forming cooling fluid counterflow between the pressure side and suction side serpentine cooling channels. The counterflow in the pressure side and suction side serpentine cooling channels creates a more uniform temperature distribution for the mid-chord region of the turbine blade than conventional serpentine cooling channels.

The leading edge cooling channel may include a plurality of impingement orifices that provide a cooling fluid pathway between the bifurcated mid-chord cooling chamber and the leading edge cooling channel. The trailing edge cooling channel may include a plurality of vortex chambers for cooling the trailing edge. In at least one embodiment, the trailing edge cooling channel may include three vortex chambers positioned in series proximate to the trailing edge of the turbine blade. The orifices for admitting cooling fluids into the vortex chambers may be offset from each other generally along a longitudinal axis of the turbine blade for increased efficiency.

The cooling system of the turbine blade is advantageous for numerous reasons. In particular, the bifurcated mid-chord cooling chamber increases the efficiency of the turbine blade cooling system in the turbine blade. For instance, the bifurcated mid-chord cooling chamber enables the overall cooling fluid supply pressure to be reduced by enabling the cooling system proximate to the pressure sidewall to be tailored based on heating load, thereby resulting in a reduction of overall blade leakage flow. The bifurcated mid-chord cooling chamber also enables high aspect ratio flow channels to be used, which improves the manufacturability of the ceramic core, reduces the difficulty of installing film cooling holes, minimizes the rotational effects on the internal heat transfer coefficient, and increases the internal convective area for the hot gas side area ratio. The bifurcated mid-chord cooling chamber also eliminates design issues, such as back flow margin (BFM) and high blowing ratio, that are typical for suction side film cooling holes in conventional designs. The bifurcated mid-chord cooling chamber may also utilize a single cooling flow circuit, which increase the cooling flow mass flux, thereby yielding a higher internal convective performance than a conventional mid-chord serpentine cooling channel.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
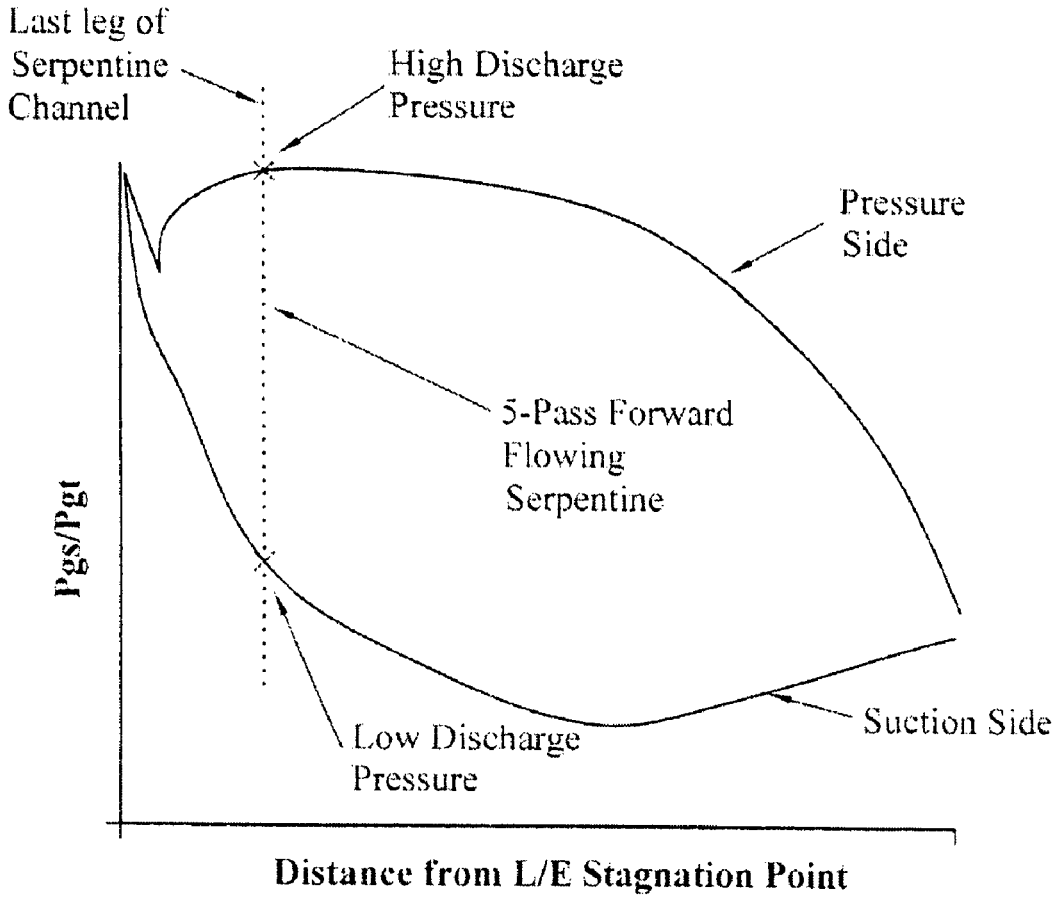
FIG. 1 PRIOR ART
FIG. 1 is a graph of the external pressure profile of a conventional turbine airfoil.
Figure 2:
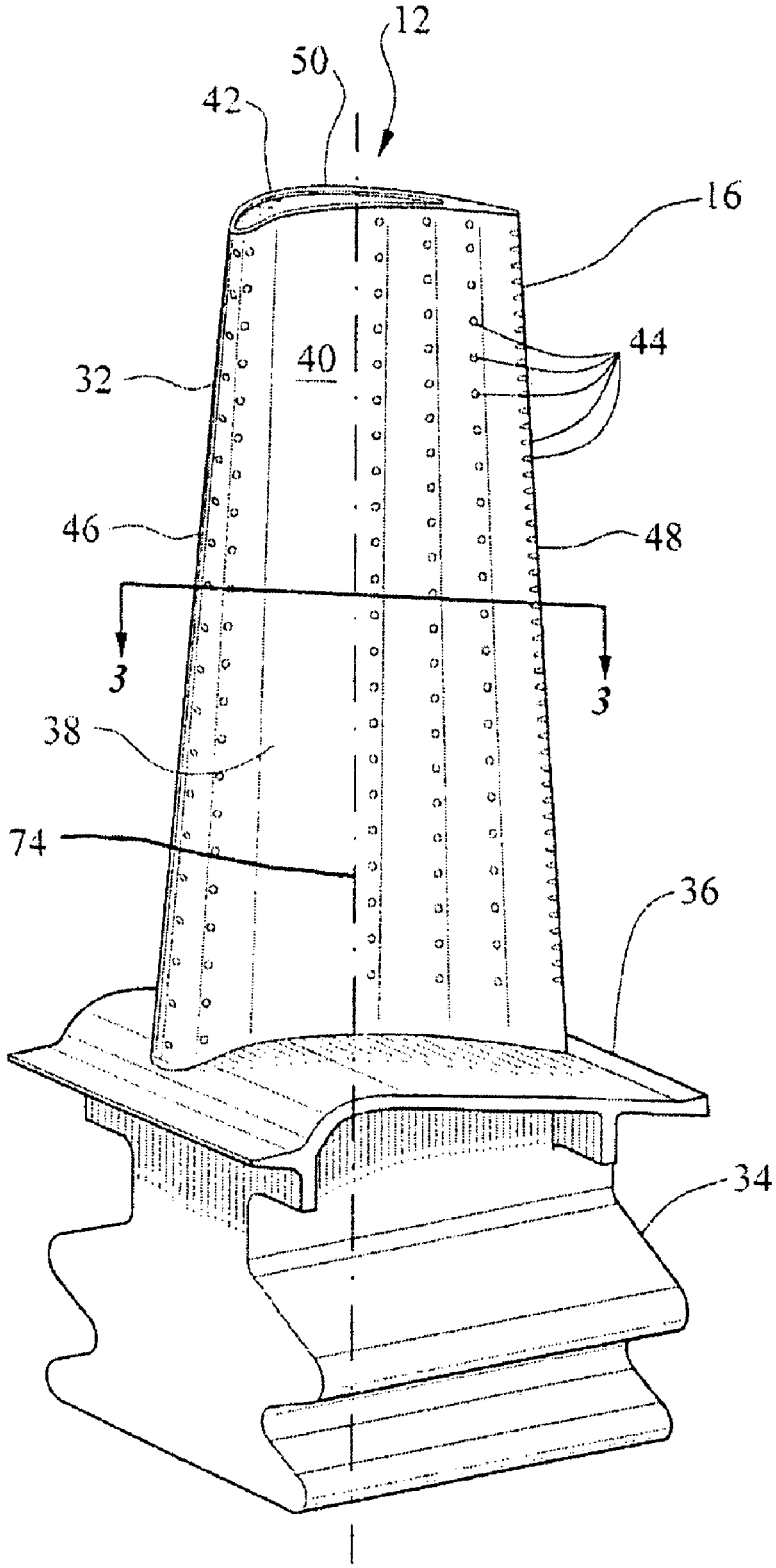
FIG. 2 is a perspective view of a turbine blade having features according to the instant invention.
Figure 3:
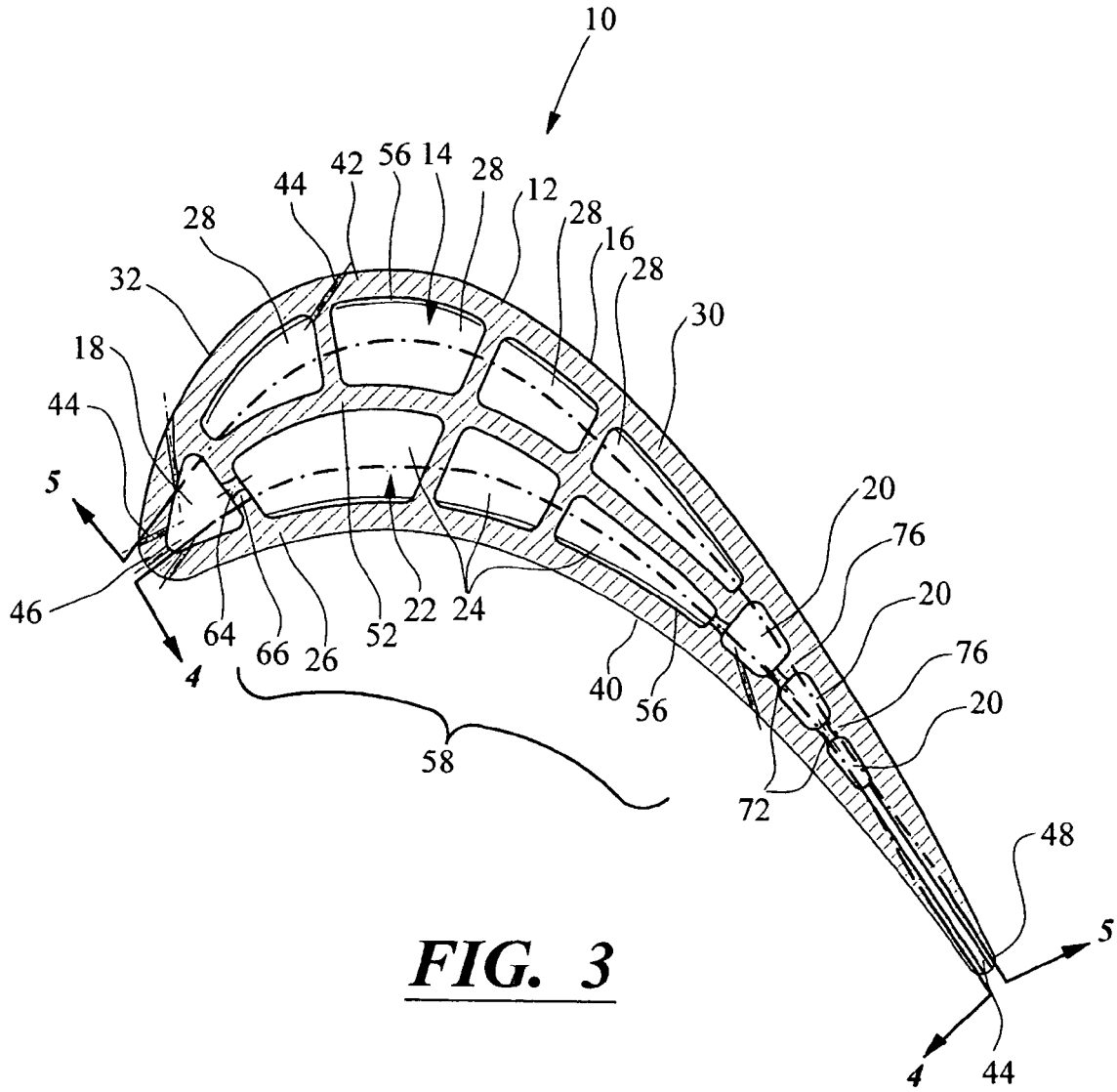
FIG. 3 is cross-sectional view of the turbine blade shown in FIG. 2 taken along section line 3-3.
Figure 5:
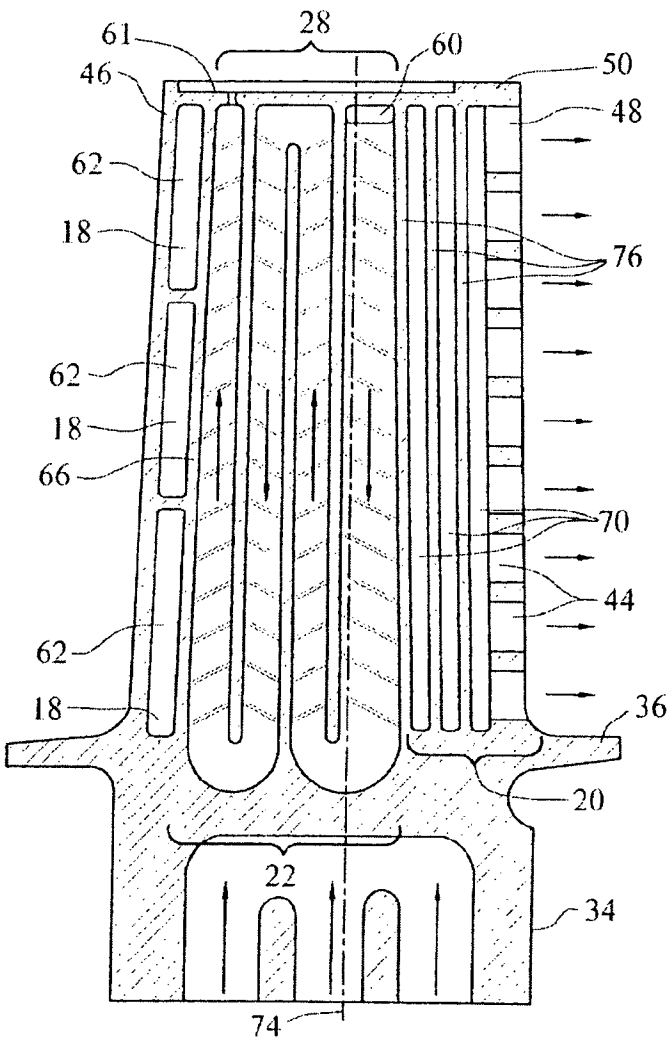
FIG. 5 is cross-sectional filleted view of the turbine blade shown in FIG. 3 taken along section line 5-5.
Figure 4:
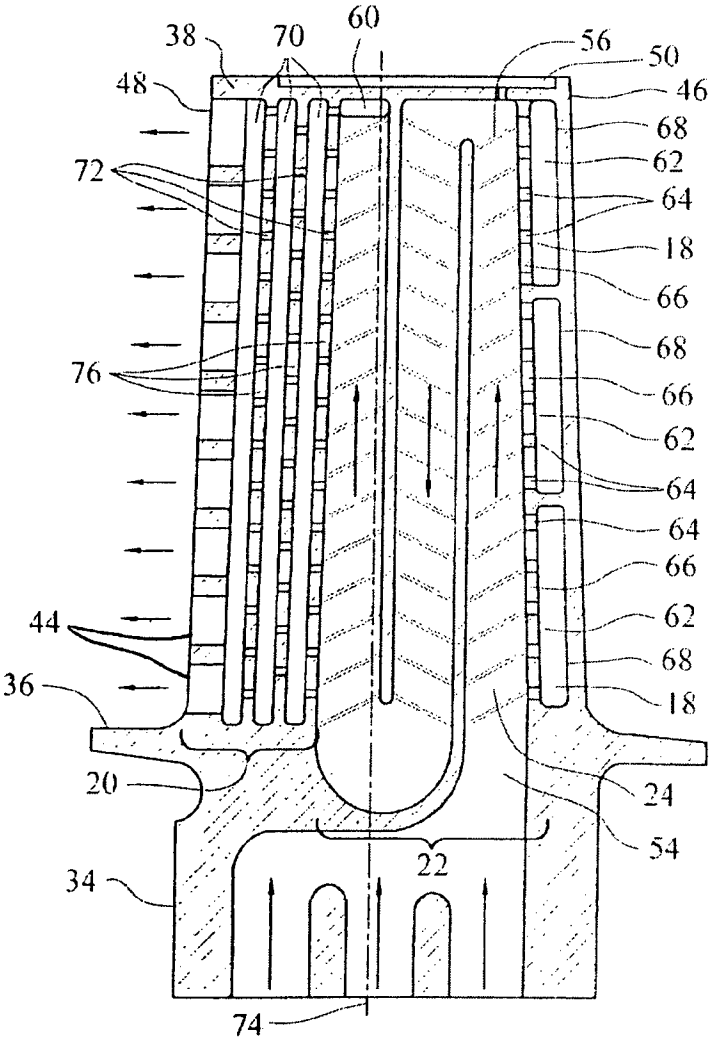
FIG. 4 is cross-sectional view, referred to as a filleted view, of the turbine blade shown in FIG. 3 taken along section line 4-4.
Figure 6:
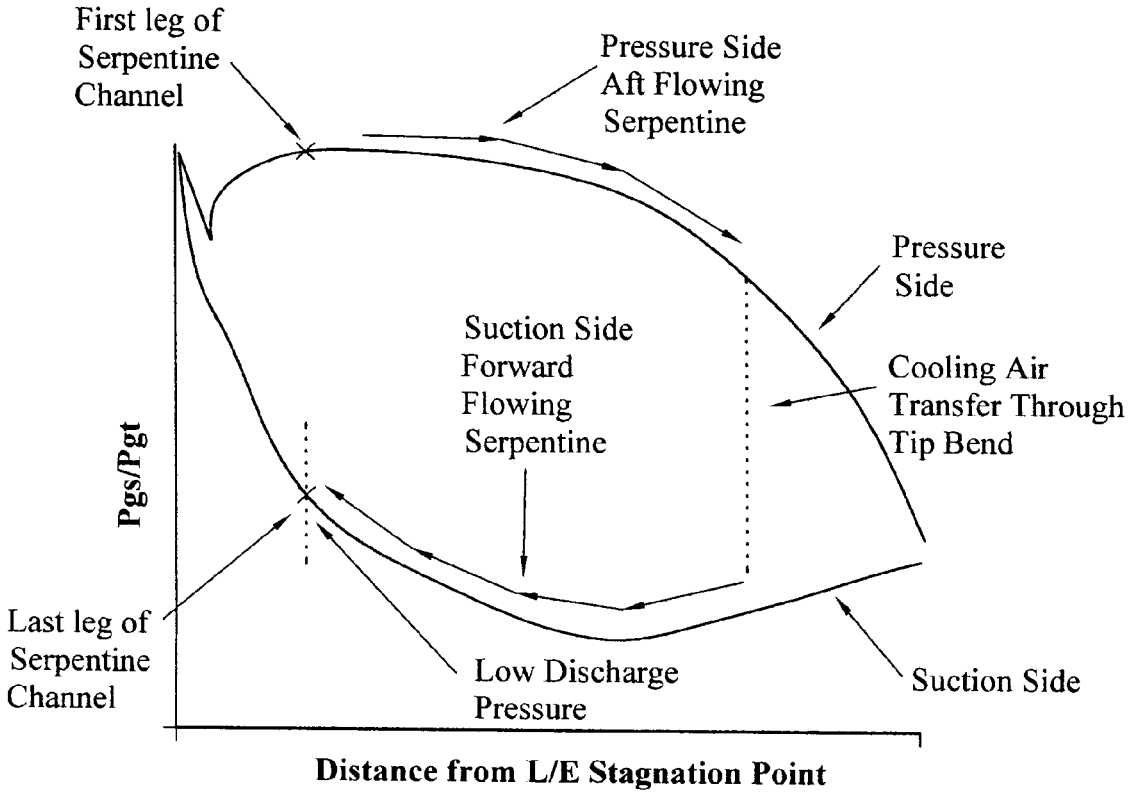
FIG. 6 is a graph of the external pressure profile of the turbine airfoil of the instant invention.

As shown in FIGS. 2-6, this invention is directed to a turbine blade cooling system 10 for turbine blades 12 used in turbine engines. In particular, the turbine blade cooling system 10 is directed to a cooling system 10 located in a cavity 14, as shown in FIGS. 3-5, positioned between two or more walls 38 forming a housing 16 of the turbine blade 12. The cooling system 10 may include one or more leading edge cooling channels 18, one or more trailing edge cooling channels 20, and a bifurcated mid-chord cooling chamber 22 positioned between the leading edge and trailing edge cooling channel 18, 20. The bifurcated mid-chord cooling chamber 22 may be formed from a pressure side serpentine cooling channel 24 in contact with a pressure side wall 26 of the turbine blade 12 and a suction side serpentine cooling channel 28 in contact with the suction side wall 30 of the turbine blade 12. The bifurcated mid-chord cooling chamber 22 may be configured to pass cooling fluids through the pressure side serpentine cooling channel 24 and exhaust the cooling fluids into the suction side serpentine cooling channel 28 to supply the suction side serpentine cooling channel 28 with cooling fluids. The cooling fluids are passed through the suction side serpentine cooling channels 28 and exhausted from turbine blade 12. The bifurcated mid-chord cooling configuration enables hot gas side pressure distribution to be tailored, as shown in FIG. 6, which yields a higher internal convection efficiency for the cooling system 10. In at least one embodiment, the cooling system 10 may form a cooling pathway having a single cooling fluid inlet 54 for admitting cooling fluids into the cooling system 10, thereby forming a single cooling flow circuit.

As shown in FIG. 2, the turbine blade 12 may be formed from a generally elongated blade 32 coupled to a root 34 at a platform 36. Blade 32 may have an outer wall 38 adapted for use, for example, in a first stage of an axial flow turbine engine. Outer wall 38 may form a generally concave shaped portion forming pressure side 40 and may form a generally convex shaped portion forming suction side 42. The cavity 14, as shown in FIGS. 3-5, may be positioned in inner aspects of the blade 32 for directing one or more gases, which may include air received from a compressor (not shown), through the blade 32 and out one or more exhaust orifices 44 in the blade 32 to reduce the temperature of the blade 32. As shown in FIG. 2, the exhaust orifices 44 may be positioned in a leading edge 46, a trailing edge 48, a tip 50, or any combination thereof, and have various configurations. The cavity 14 may be arranged in various configurations and is not limited to a particular flow path.

As shown in FIG. 3, the bifurcated mid-chord cooling chamber 22 may be formed from a pressure side serpentine cooling channel 24 and a suction side serpentine cooling channel 28 separated by a mid-chord rib 52. The pressure side and suction side serpentine cooling channels may be positioned generally parallel to a longitudinal axis 74 of the blade 32. The pressure side serpentine channel 24 includes an inlet 54 proximate to the root 34 for receiving cooling fluids from a cooling fluid source. In at least one embodiment, the inlet 54 is the only inlet for cooling fluids to enter the turbine blade cooling system 10.

The pressure side serpentine cooling channel 24 may extend from a position proximate the root 34 to the tip 50 of the blade 32. The pressure side serpentine cooling channel 24 may be formed from at least a two pass serpentine cooling channel, and, in at least one embodiment as shown in FIGS. 3 and 4, may be a triple pass serpentine cooling channel. The pressure side serpentine cooling channel 24 may include a plurality of trip strips 56 positioned in the channel 24 for increasing the efficiency of the cooling system 10. The trip strips 56 in the pressure side serpentine cooling channel 24 may be positioned at various angles and spacing to increase the efficiency of the cooling system 10.

The suction side serpentine cooling channel 28 may extend from a position proximate to the root 34 to the tip 50 of the blade 32, in a similar fashion to the pressure side serpentine cooling channel 24. The suction side serpentine cooling channel 28 may be formed from at least a two pass serpentine cooling channel, and in at least one embodiment, as shown in FIGS. 3 and 5, may be a quadruple pass serpentine cooling channel. The suction side serpentine cooling channel 28 may include a plurality of trip strips 56 positioned in the channel 28 for increasing the efficiency of the cooling system 10. The trip strips 56 in the suction side serpentine cooling channel 28 may be positioned at various angles and spacing to increase the efficiency of the cooling system 10.

The suction side serpentine cooling channel 28 may be positioned relative to the pressure side serpentine cooling channel 24 such that a cooling fluid flow direction through the suction side serpentine cooling channel 28 is generally opposite to the cooling fluid flow in adjacent portions of the pressure side serpentine cooling channel 24, thereby forming cooling fluid counterflow between the pressure side and suction side serpentine cooling channels 24, 28. The counterflow between the pressure side and suction side serpentine cooling channels 24, 28 may form a more uniform temperature distribution than conventional cooling system configurations for the mid-chord region 58, thereby reducing thermal stresses in the blade 32.

The suction side serpentine cooling channel 28 may be in communication with the pressure side serpentine cooling channel 24 to receive cooling fluids. In at least one embodiment, the suction side serpentine cooling channel 28 may include an inlet 60 that provides a pathway through the mid-chord rib 52. In at least one embodiment, the inlet 60 may be positioned proximate to the tip 50 of the blade 32. The inlet 60 may be positioned at an end of the pressure side serpentine cooling channel 24 and at the beginning of the suction side serpentine cooling channel 28. The suction side serpentine cooling channel 28 may also include an exhaust outlet 61 in the tip 50 of the blade 32 for exhausting cooling fluids from the suction side serpentine cooling channel 28.

In at least one embodiment, as shown in FIG. 4, the leading edge cavity 18 may be formed from a plurality of cooling chambers 62. The leading edge cavity 18 may include a plurality of impingement orifices 64 in a rib 66 separating the leading edge cooling channel 18 from the bifurcated mid-chord cooling chamber 22. In at least one embodiment, the plurality of impingement orifices 64 may extend from the pressure side serpentine cooling channel 24 to the leading edge cooling channel 18. The rib 66 may be positioned in the blade 32 such that cooling fluids flowing through the impingement orifices 64 impinge on a backside surface 68 of the leading edge 46.

The trailing edge cooling channel 20 may be formed from a variety of cooling channel configurations. In at least one embodiment, the trailing edge cooling channel 20 may receive cooling fluids from the pressure side serpentine cooling channel 24. In at least one embodiment, as shown in FIG. 3, the trailing edge cooling channel 20 may be formed from one or more vortex chambers 70. The trailing edge cooling channel 20 may be formed from three vortex chambers positioned in series and generally parallel to the trailing edge 48 of the blade 32. Each vortex chamber 70 may include orifices 72 in a rib 76 for admitting cooling fluids into the chambers 70. As shown in FIG. 4, the orifices 72 positioned in a rib 76 forming a first chamber 70 may be offset along a longitudinal axis 74 of the blade 32 relative to orifices 72 in a rib 76 of an adjacent chamber 70. In an alternative embodiment, the orifices 72 may be impingement orifices configured to admit cooling fluids into the trailing edge cooling channel 20 and impinge on a surface.

The turbine blade cooling system 10 for turbine blades 12 may be formed from a composite core formed from two or more cores members. For instance, in at least one embodiment, the leading edge cooling channel 18, the pressure side serpentine cooling channel 24, and the trailing edge cooling channel 20 may be formed from a single core die, and the suction side serpentine cooling channel 28 may be formed from a single core die. The two cores may be assembled together before casting. In other embodiments, other combinations of internal cooling chambers may be used. The core members may be formed from any conventional or later developed material capable of maintaining the necessary structural integrity under turbine engine operating conditions.

During use, cooling fluids may be passed from a cooling fluid supply (not shown), such as but not limited to, a compressor, to the root 34. Cooling fluids are then admitted into the cooling system 12 through the inlet 54 between the root 34 and the pressure side serpentine cooling channel 24. A portion of the cooling fluids entering the pressure side serpentine cooling channel 24 may pass into the leading edge cooling channel 18. The cooling fluids pass through a plurality of impingement orifices 64 in the rib 66 separating the leading edge cooling channel 18 from the bifurcated mid-chord cooling chamber 22. The cooling fluids flow through the pressure side serpentine cooling channel 24 absorbing heat from the surfaces of the channel 24 formed by the pressure sidewall 26 and the mid-chord rib 52. The cooling fluids pass through the pressure side serpentine cooling channel 24 generally along the longitudinal axis 74 and move in a direction generally from the leading edge 46 to the trailing edge 48. After passing through the pressure side serpentine cooling channel 24, a portion of the cooling fluids may pass into the trailing edge cooling channel 20. The cooling fluids may pass into vortex chambers 70 where a plurality of vortices are created to reduce the temperature of the trailing edge. The cooling fluids may be exhausted from the trailing edge cooling channel 20 through one or more exhaust orifices 44.

After passing completely through the pressure side serpentine cooling channel 24, the cooling fluids pass through the inlet 60 and into the suction side serpentine cooling channel 28. The cooling fluids flow through the suction side serpentine channel 28 generally chordwise from near the trailing edge 48 to the leading edge 46. The cooling fluids may be exhausted from the suction side serpentine channel 28 through the exhaust outlet 61.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

the cooling system, comprising:

at least one leading edge cooling channel positioned in close proximity to the leading edge of the generally elongated blade;

at least one trailing edge cooling channel positioned in close proximity to the trailing edge of the generally elongated blade;

a bifurcated mid-chord cooling chamber positioned between the at least one leading edge cooling channel and the at least one trailing edge cooling channel, wherein the mid-chord cooling channel includes a pressure side serpentine cooling channel in contact with a pressure sidewall of the generally elongated blade and a suction side serpentine cooling channel in contact with a suction sidewall of the generally elongated blade and separated from the at least one pressure side serpentine cooling channel by a mid-chord rib;

an aperture in the mid-chord rib providing a cooling fluid passageway between the pressure and suction side serpentine cooling channels, wherein the aperture is positioned in the mid-chord rib to exhaust cooling fluids from the pressure side serpentine cooling channel and to supply cooling fluids to the suction side serpentine cooling channel; and wherein the suction side serpentine cooling channel is positioned relative to the pressure side serpentine cooling channel such that a cooling fluid flow direction through the suction side serpentine cooling channel is generally opposite to the cooling fluid flow in adjacent portions of the pressure side serpentine cooling channel, thereby forming cooling fluid counterflow between the pressure side and suction side serpentine cooling channels.

2. The turbine blade of claim 1, wherein the aperture in the mid-chord rib is positioned proximate to an end of the pressure side serpentine cooling channel and a beginning of the suction side serpentine cooling channel of the turbine blade.

3. The turbine blade of claim 1, wherein the pressure side serpentine cooling channel in contact with the pressure sidewall of the generally elongated blade is a triple pass serpentine cooling channel.

4. The turbine blade of claim 1, wherein the suction side serpentine cooling channel in contact with the suction sidewall of the generally elongated blade is a quadruple pass serpentine cooling channel.

5. The turbine blade of claim 1, further comprising a plurality of trip strips in the suction side serpentine cooling channel and a plurality of trip strips in the pressure side serpentine cooling channel.

6. The turbine blade of claim 1, further comprising at least one orifice in a rib positioned between the at least one leading edge cooling channel and the pressure side serpentine cooling channel.

7. The turbine blade of claim 1, wherein the at least one trailing edge cooling channel is formed from at least one vortex chamber for creating vortices from the cooling fluids.

8. The turbine blade of claim 7, wherein the at least one vortex chamber may be formed from three vortex chambers positioned in series and generally parallel to the trailing edge of the generally elongated blade.

9. The turbine blade of claim 8, wherein orifices in a first rib extending between adjacent vortex chambers are offset along a longitudinal axis of the elongated blade relative to orifices in another rib extending between vortex chambers.

10. The turbine blade of claim 1, wherein the at least one trailing edge cooling channel includes a plurality of impingement orifices in a rib separating the mid-chord cooling chamber and the at least one trailing edge cooling channel.

11. The turbine blade of claim 1, further comprising a plurality of exhaust orifices in the trailing edge for exhausting cooling fluids from the at least one trailing edge cooling channel.

12. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

the cooling system, comprising:

at least one leading edge cooling channel positioned in close proximity to the leading edge of the generally elongated blade;

at least one trailing edge cooling channel positioned in close proximity to the trailing edge of the generally elongated blade;

a bifurcated mid-chord cooling chamber positioned between the at least one leading edge cooling channel and the at least one trailing edge cooling channel, wherein the mid-chord cooling channel includes a pressure side serpentine cooling channel in contact with a pressure sidewall of the generally elongated blade and a suction side serpentine cooling channel in contact with a suction sidewall of the generally elongated blade and separated from the at least one pressure side serpentine cooling channel by a mid-chord rib;

an aperture in the mid-chord rib providing a cooling fluid passageway between the pressure and suction side serpentine cooling channels, wherein the aperture is positioned in the mid-chord rib to exhaust cooling fluids from the pressure side serpentine cooling channel and to supply cooling fluids to the suction side serpentine cooling channel;

at least one orifice in a rib positioned between the at least one leading edge cooling channel and the pressure side serpentine cooling channel; and wherein the at least one orifice comprises a plurality of impingement orifices adapted to allow cooling fluids to pass from the pressure side serpentine cooling channel to the at least one leading edge cooling channel and impinge on an inner surface of the wall forming the leading edge.

13. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

the cooling system, comprising:

at least one leading edge cooling channel positioned in close proximity to the leading edge of the generally elongated blade;

at least one trailing edge cooling channel positioned in close proximity to the trailing edge of the generally elongated blade;

a bifurcated mid-chord cooling chamber positioned between the at least one leading edge cooling channel and the at least one trailing edge cooling channel, wherein the mid-chord cooling channel includes a pressure side serpentine cooling channel in contact with a pressure sidewall of the generally elongated blade and a suction side serpentine cooling channel in contact with a suction sidewall of the generally elongated blade and separated from the at least one pressure side serpentine cooling channel by a mid-chord rib;

an aperture in the mid-chord rib positioned proximate to an end of the pressure side serpentine cooling channel and a beginning of the suction side serpentine cooling channel of the turbine blade;

wherein the aperture provides a cooling fluid passageway between the pressure and suction side serpentine cooling channels to exhaust cooling fluids from the pressure side serpentine cooling channel and to supply cooling fluids to the suction side serpentine cooling channel; and wherein the suction side serpentine cooling channel is positioned relative to the pressure side serpentine cooling channel such that a cooling fluid flow direction through the suction side serpentine cooling channel is generally opposite to the cooling fluid flow in adjacent portions of the pressure side serpentine cooling channel, thereby forming cooling fluid counterflow between the pressure side and suction side serpentine cooling channels.

14. The turbine blade of claim 13, wherein the pressure side serpentine cooling channel in contact with the pressure sidewall of the generally elongated blade is a triple pass serpentine cooling channel, and the suction side serpentine cooling channel in contact with the suction sidewall of the generally elongated blade is a quadruple pass serpentine cooling channel.

15. The turbine blade of claim 14, further comprising a plurality of trip strips in the suction side serpentine cooling channel and a plurality trip strips in the pressure side serpentine cooling channel.

16. The turbine blade of claim 14, further comprising a plurality of impingement orifices in a rib positioned between the at least one leading edge cooling channel and the pressure side serpentine cooling channel and adapted to allow cooling fluids to pass from the pressure side serpentine cooling channel to the at least one leading edge cooling channel and impinge on an inner surface of the wall forming the leading edge.

17. The turbine blade of claim 14, wherein the at least one trailing edge cooling channel is formed from a plurality of vortex chambers positioned in series and generally parallel to the trailing edge of the generally elongated blade for creating vortices from the cooling fluids, and wherein orifices in a first rib extending between adjacent vortex chambers are offset along a longitudinal axis of the elongated blade relative to orifices in another rib extending between vortex chambers.

18. The turbine blade of claim 14, wherein the at least one trailing edge cooling channel includes a plurality of impingement orifices in a rib separating the mid-chord cooling chamber and the at least one trailing edge cooling channel.

19. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

the cooling system, comprising:

at least one leading edge cooling channel positioned in close proximity to the leading edge of the generally elongated blade;

at least one trailing edge cooling channel positioned in close proximity to the trailing edge of the generally elongated blade;

a bifurcated mid-chord cooling chamber positioned between the at least one leading edge cooling channel and the at least one trailing edge cooling channel, wherein the mid-chord cooling channel includes a pressure side serpentine cooling channel in contact with a pressure sidewall of the generally elongated blade and a suction side serpentine cooling channel in contact with a suction sidewall of the generally elongated blade and separated from the at least one pressure side serpentine cooling channel by a mid-chord rib;

an aperture in the mid-chord rib providing a cooling fluid passageway between the pressure and suction side serpentine cooling channels, wherein the aperture is positioned in the mid-chord rib to exhaust cooling fluids from the pressure side serpentine cooling channel and to supply cooling fluids to the suction side serpentine cooling channel; and wherein the at least one trailing edge cooling channel is formed from at least one vortex chamber for creating vortices from the cooling fluids.

20. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

the cooling system, comprising:

at least one leading edge cooling channel positioned in close proximity to the leading edge of the generally elongated blade;

at least one trailing edge cooling channel positioned in close proximity to the trailing edge of the generally elongated blade;

a bifurcated mid-chord cooling chamber positioned between the at least one leading edge cooling channel and the at least one trailing edge cooling channel, wherein the mid-chord cooling channel includes a pressure side serpentine cooling channel in contact with a pressure sidewall of the generally elongated blade and a suction side serpentine cooling channel in contact with a suction sidewall of the generally elongated blade and separated from the at least one pressure side serpentine cooling channel by a mid-chord rib;

an aperture in the mid-chord rib providing a cooling fluid passageway between the pressure and suction side serpentine cooling channels;

wherein the aperture is positioned in the mid-chord rib to exhaust cooling fluids from the pressure side serpentine cooling channel and to supply cooling fluids to the suction side serpentine cooling channel; and wherein the at least one trailing edge cooling channel includes a plurality of impingement orifices in a rib separating the mid-chord cooling chamber and the at least one trailing edge cooling channel.

* * * * *